US010596846B2

(12) United States Patent
Bassett et al.

(10) Patent No.: US 10,596,846 B2
(45) **Date of Patent: *Mar. 24, 2020**

(54) GREETING CARD HAVING COMPRESSED OBJECT THEREIN AND METHOD OF SELECTIVELY CONTROLLING DEFORMATION THEREOF

(71) Applicant: Hallmark Cards, Incorporated, Kansas City, MO (US)

(72) Inventors: Lainie Bassett, Olathe, KS (US); Kari Walberg, Overland Park, KS (US); Orlanda Lacy, Kansas City, MO (US)

(73) Assignee: Hallmark Cards, Incorporated, Kansas City, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/200,306

(22) Filed: Nov. 26, 2018

(65) Prior Publication Data

US 2019/0092079 A1 Mar. 28, 2019

Related U.S. Application Data

(63) Continuation of application No. 15/442,153, filed on Feb. 24, 2017, now Pat. No. 10,137,723.

(51) Int. Cl.

| | |
|---|---|
| ***B65D 85/07*** | (2017.01) |
| ***B42D 15/04*** | (2006.01) |
| ***B65D 73/00*** | (2006.01) |
| ***B65B 7/02*** | (2006.01) |
| ***B65B 31/00*** | (2006.01) |
| ***B65B 61/20*** | (2006.01) |
| ***B65D 75/30*** | (2006.01) |
| ***B65D 75/52*** | (2006.01) |

(Continued)

(52) U.S. Cl.

CPC ..... *B42D 15/045* (2013.01); *B42D 15/042* (2013.01); *B65B 7/02* (2013.01); *B65B 31/00* (2013.01); *B65B 61/20* (2013.01); *B65D 73/0014* (2013.01); *B65D 73/0078* (2013.01); *B65D 73/0092* (2013.01); *B65D 75/305* (2013.01); *B65D 75/522* (2013.01); *B65D 75/545* (2013.01); *B65D 81/203* (2013.01); *B65D 85/07* (2018.01)

(58) Field of Classification Search

None

See application file for complete search history.

(56) References Cited

U.S. PATENT DOCUMENTS

| | | | |
|---|---|---|---|
| 4,439,941 | A | 4/1984 | Halperin |
| 4,936,460 | A | 6/1990 | Meyer |

(Continued)

OTHER PUBLICATIONS

Notice of Allowance dated Jul. 30, 2019 in Canadian Patent Application No. 2,986,869, 1 page.

*Primary Examiner* — Kristina N Junge

(74) *Attorney, Agent, or Firm* — Shook, Hardy & Bacon L.L.P.

(57) ABSTRACT

A greeting card having a transparent and flexible pouch enclosing a deformable object is disclosed. The transparent and flexible pouch is vacuum sealed with the deformable object inside, such that the deformable object compresses. A transparent insert may be placed inside of the transparent and flexible pouch, in order to minimize disfiguration of the deformable object during the compression process.

20 Claims, 7 Drawing Sheets

(51) Int. Cl.
*B65D 75/54* (2006.01)
*B65D 81/20* (2006.01)

(56) References Cited

U.S. PATENT DOCUMENTS

| | | | | |
|---|---|---|---|---|
| 4,951,404 | A * | 8/1990 | Lithwick | B42D 15/045 206/462 |
| 5,199,745 | A | 4/1993 | Balsamo | |
| 5,699,909 | A | 12/1997 | Foster | |
| 5,980,352 | A | 11/1999 | Rigberg | |
| 6,030,274 | A | 2/2000 | Kaplan | |
| 6,691,868 | B2 | 2/2004 | Roshdy | |
| 8,683,721 | B1 | 4/2014 | Bogdanski et al. | |
| 9,102,459 | B2 * | 8/2015 | Milican | B65D 75/38 |
| 2004/0128876 | A1 | 7/2004 | Cheek et al. | |
| 2007/0113432 | A1 | 5/2007 | Poole | |
| 2007/0220829 | A1 | 9/2007 | Li | |
| 2011/0005109 | A1 | 1/2011 | Junkins | |
| 2014/0196325 | A1 | 7/2014 | Bowen et al. | |

* cited by examiner

GREETING CARD HAVING COMPRESSED OBJECT THEREIN AND METHOD OF SELECTIVELY CONTROLLING DEFORMATION THEREOF

CROSS-REFERENCE TO RELATED APPLICATIONS

This Non-Provisional Patent Application, entitled "Greeting Card Having Compressed Object Therein and Method of Selectively Controlling Deformation Thereof," claims priority benefit of co-pending U.S. Non-Provisional patent application Ser. No. 15/442,153, the same title, and filed on Feb. 24, 2017. The entirety of the aforementioned Application is incorporated herein by reference.

STATEMENT REGARDING FEDERALLY SPONSORED RESEARCH OR DEVELOPMENT

Not applicable.

TECHNICAL FIELD

The present invention relates to selective deformation of an object. More particularly, the present invention relates to selectively controlling deformation of a compressed object for insertion into a greeting card as a gift.

BACKGROUND

Greeting cards have been purchased for decades to accompany a gift as a way to present a thoughtful sentiment to a recipient and to personalize the gift giving experience. Often times purchasers of greeting cards must send the card to the recipient through the mail. In those instances, the sender must either package the gift and greeting card together in a separate box or forego send a gift with the greeting card. Mail regulations limit the size of an object that may be placed in standard greeting card envelopes. Accordingly, it would be desirable to be able to send a gift larger than normally allowed in a greeting card.

BRIEF SUMMARY OF THE INVENTION

The invention is defined by the claims below. This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

In an effort to enable the sending of greeting cards with larger than normally permitted gifts therein, the present invention provides for insertion of a small gift, such as a deformable object (e.g., a plush item), into a greeting card. Unaltered, the insertion of an object having any significant thickness creates a lump in the card and envelope that prevents the greeting card from being mailed. Accordingly, it is envisioned that such object may be a plush item and the plush item may be compressed by vacuum sealing the same within a transparent and flexible pouch, which may then be coupled to the greeting card. The vacuum sealing of the plush item reduces the size of the object and allows the greeting card to achieve the size required for mailing purposes. Upon removing the object from the vacuum sealed pouch, the previously compressed object returns to its normal size and shape.

While the vacuum sealing process achieved the desire to reduce the thickness of the object, it created a new problem of deforming and disfiguring the object, thereby making it less attractive or even undesirable. In some instances, it would even make the object unrecognizable. In order to overcome this problem, an insert having relatively rigid properties may be placed within the vacuum-sealed transparent and flexible pouch. This insert is relatively incompressible compared to the object and the pouch, and thus, the compressable object (e.g., the plush item) compresses and distorts from the side opposite the insert (e.g., the rear of the pouch), instead of from the side pressed up against the non-deforming insert (e.g., the front of the pouch). In doing so, the attractiveness of the front of the plush item is preserved. Additionally, to preserve space within the pouch, the insert may be cut to the shape of the outline of the object. Finally, the vacuum-sealed pouch having the compressed object therein is secured inside a greeting card. When the recipient opens the card, the vacuum-sealed pouch may be removed and opened, thereby returning the object to its normal size.

In another aspect of the invention, one section of the transparent and flexible pouch may be less deformable than other sections of the pouch. In this aspect, the need for an insert is alleviated, as the less deformable section of the pouch minimizes the deformation of the deformable object adjacent the less deformable section, thereby preserving the attractiveness of the deformable object in that area.

Aspects of the present invention are generally directed to incorporation of the controlled deformation technique into a greeting card having a card body with a front panel and a rear panel, a transparent and flexible pouch coupled to the card body, wherein the transparent and flexible pouch is sealed under vacuum-pressure, a plush item having a front surface and a rear surface, and a transparent insert which is more rigid than the transparent and flexible pouch. The transparent and flexible pouch of the greeting card contains the plush item and the transparent insert. Further, the transparent insert is positioned between one of the front and rear surfaces of the plush item and an inside wall of the transparent and flexible pouch, whereby the transparent insert minimizes deformation of a surface of the plush item during the vacuum sealing process.

In another aspect of the present invention, a greeting card is provided having a card body with a plurality of panels, a transparent and flexible pouch coupled to the card body, and a deformable object positioned within the flexible pouch, wherein at least one section of the pouch is less deformable than other sections of the pouch. Additionally, the transparent and flexible pouch encloses the deformable object such that when the transparent and flexible pouch is vacuum-sealed, the deformable object is maintained in a compressed state, whereby opening the transparent and flexible pouch returns the deformable object to a rest state.

Additional objects, advantages, and novel features of the invention will be set forth in part in the description that follows, and in part will become apparent to those skilled in the art upon examination of the following, or may be learned by practice of the invention.

BRIEF DESCRIPTION OF SEVERAL VIEWS OF THE DRAWINGS

The present invention is described in detail below with reference to the attached drawing figures, wherein.

DETAILED DESCRIPTION OF THE INVENTION

As briefly described hereinabove, the present invention generally relates to a greeting card having a transparent and flexible pouch for receiving a deformable object. For example, it is envisioned that greeting cards can be combined with gifts by having a small deformable object, such as a plush toy, inserted within a transparent and flexible pouch, and coupled to the card. This, however, creates a lump which prevents the greeting card from being mailed. Vacuum-sealing the deformable object has been found effective to reduce the amount of volume, and particularly thickness, that the deformable object occupies within the transparent and flexible pouch. However, during the vacuum-sealing process, the deformable object has a tendency to compress unevenly, there becoming disfigured or unattractive. Accordingly, a rigid and transparent insert may be placed within the transparent and flexible pouch to selectively control deformation, such that the aesthetics of the deformable object are preserved.

Figure 1:
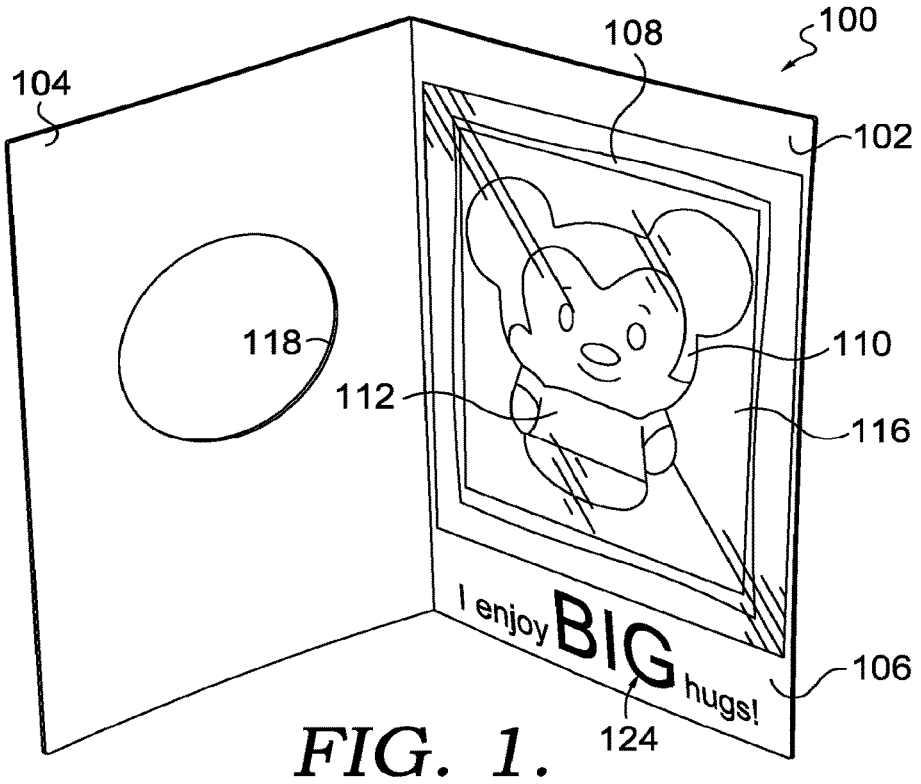
FIG. 1 is a perspective view of an embodiment of an exemplary greeting card having a deformable object in accordance with aspects of the present invention described herein.

Accordingly, FIG. 1 depicts an exemplary greeting card 100, in accordance with aspects herein. The greeting card 100 generally includes a card body 102 having a front panel 104 and a back panel 106. However, aspects in which the front panel 104 and the back panel 106 are separated by intermediary or additional panels are considered to be within the scope of this disclosure. Similarly, a card body 102 having only a front panel 104 is also contemplated by and within the scope of the present invention. The exemplary greeting card 100, in the illustrated embodiment, further comprises a transparent and flexible pouch 108. The pouch 108 defines an interior cavity into which items may be placed, as discussed below. The pouch 108 is depicted in FIG. 1 as coupled to a front surface of the back panel 106. Alternatively, the transparent and flexible pouch 108 may be coupled to a rear surface of the back panel 106. Alternatively, in accordance with aspects herein, the transparent and flexible pouch 108 may be integrally formed into the rear panel 106. Alternatively, the transparent and flexible pouch 108 may be coupled to a rear surface of the front panel 104.

With continued reference to FIG. 1 and in accordance with aspects herein, the transparent and flexible pouch 108 further contains a deformable object 110. As discussed previously, once the transparent and flexible pouch 108 has received the deformable object 110, the transparent and flexible pouch 108 may be vacuum-sealed such that the volume of the deformable object 110 is reduced, and in particular its thickness. In accordance with aspects herein, the deformable object 110 may be said to be in a "compressed state" when its volume has been reduced due to vacuum-pressure. Conversely, when the deformable object 110 is in its natural and uncompressed state, this is generally referred to as its "rest state."

Figure 3:
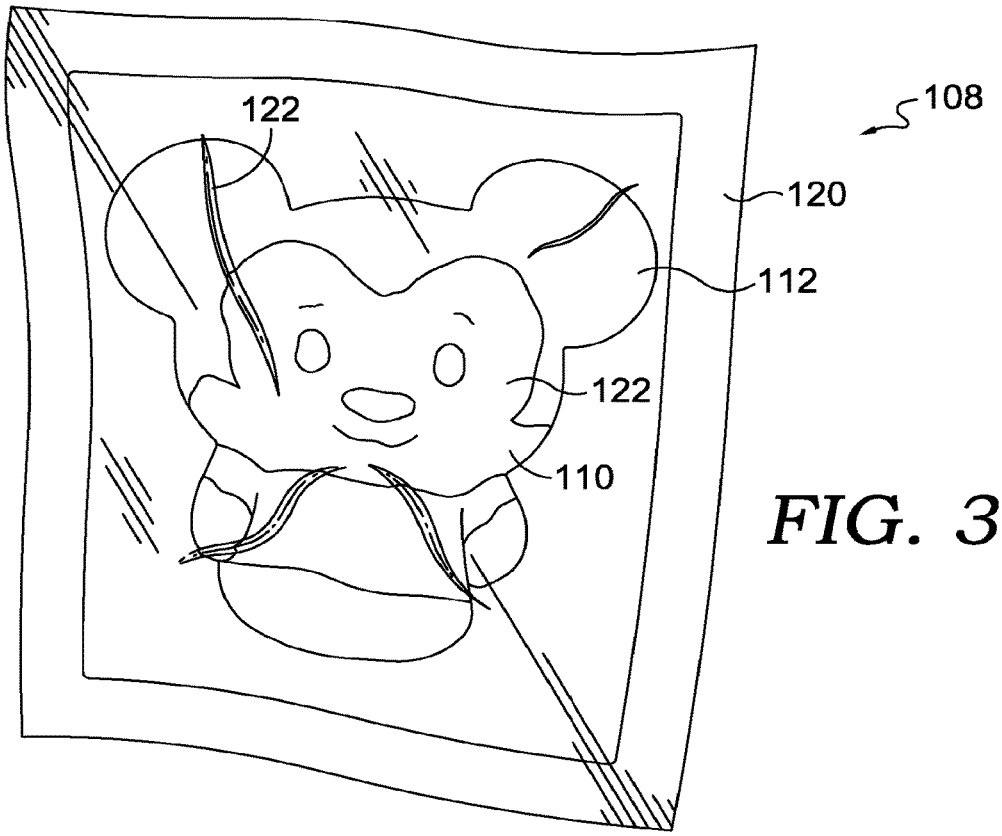
FIG. 3 is a front view of a transparent and flexible pouch having a deformable object therein in a compressed state, but without using an insert of the present invention.

In accordance with aspects herein, the deformable object 110 may be a plush item or another type of item that reduces its volume when the transparent and flexible pouch 108 is placed under vacuum-seal. In other words, the deformable object 110 may be formed from plush, foam, fabric, or any material having generally compressible properties. However, it was noticed that as the deformable object 110 compresses, it may become disfigured or unaesthetically appealing once it has been vacuum-sealed within the transparent and flexible pouch 108, as illustrated in FIG. 3. In order to alleviate this problem, a transparent insert 116 may be placed inside the transparent and flexible pouch 108 between the front surface 112 of the deformable object 110 and a front wall of the pouch 108. The transparent insert 116 is configured to generally be more rigid than the transparent and flexible pouch 108. In doing so, the transparent insert 116 serves to minimize deformation of the portion of the deformable object 110 pressed up against the insert 116 as the insert 116 does not generally deform.

With continued reference to FIG. 1, the front panel 104 of the greeting card may comprise an aperture 118, such that the deformable object 110 is visible through the aperture 118 when the greeting card 100 is in the closed configuration. In other words, when the front panel 104 lies generally parallel with the rear panel 106, the aperture 118 allows the front surface 112 of the deformable object 110 to be seen, thus increasing the likelihood that a customer purchases the exemplary greeting card 100.

In accordance with aspects herein, the front surface 112 of the deformable object 110 may include the face of a character, such as the animal depicted in FIG. 1. Additionally, the exemplary greeting card 100 may further comprise a message 124 that may be printed on the front panel 104, the rear panel 106, or both. The message 124 may correspond to the type of the deformable object 110. For example, in FIG. 1, the deformable object 110 is depicted as a plush bear in a "hugging" configuration. Accordingly, the message 124 reads, "I enjoy BIG hugs!", which corresponds to the plush bear in a "hugging" configuration. In another example, in FIG. 2, a deformable object 210 is depicted as a plush Christmas tree. Accordingly, in this example, a message 224 on an exemplary greeting card 200 of FIG. 2 reads, "Merry Christmas!"

Figure 2:
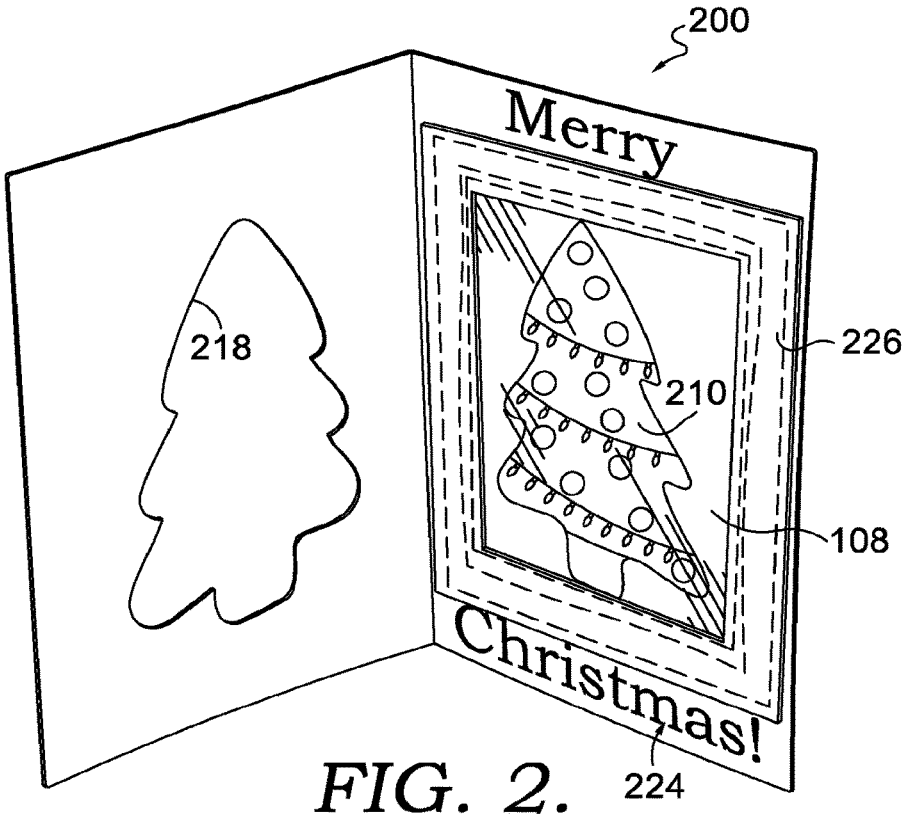
FIG. 2 is a perspective view of a second embodiment of an exemplary greeting card having a deformable object in accordance with aspects of the present invention described herein.

Turning now to FIG. 2, an exemplary greeting card 200 is depicted, in which an aperture 218 corresponds to a shape of the deformable object 210. For example, and as depicted in FIG. 2, the deformable object 210 is depicted as a plush Christmas tree. Accordingly, the aperture 218 corresponds to the shape of the outline of the deformable object 210, such that the entirety of the deformable object 210 may been seen when the greeting card 200 is in a closed configuration.

Figure 7:
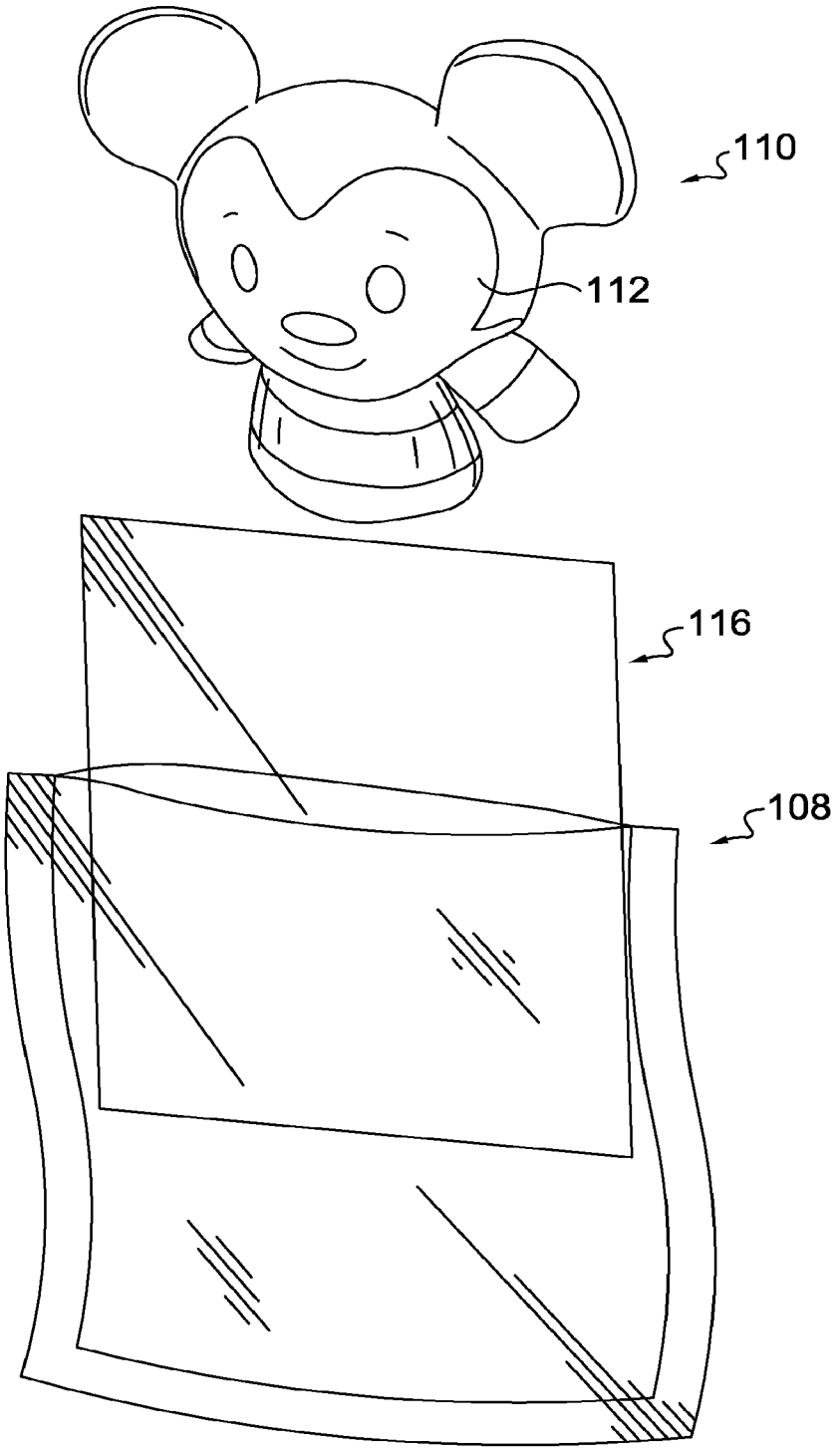
FIG. 7 is a partially-exploded view of the transparent and flexible pouch of FIG. 1 during an assembly phase receiving a transparent insert and the deformable object.

Turning now to FIG. 3, a front view of the transparent and flexible pouch 108 with the deformable object 110 vacuum sealed therein is depicted. The pouch 108 is generally made of two sheets of transparent and flexible material, as depicted in FIG. 7. The sheets are sealed together on three sides initially, with the top left open for insertion of the deformable object 110, as also depicted in FIG. 7. Once the deformable object 110 is inserted in the pouch 108, the air is removed from inside the pouch, thereby allowing atmospheric air pressure to compress the pouch 108 and the deformable object 110. When the desired level of compression has occurred, the top side of the pouch is sealed to maintain the vacuum in the pouch 108 and retain the deformable object 110 in its compressed state. The top side and the other sides may be sealed together by heating the two sheets of material to melt them together, as known in the art. The sheets may be sealed together around the periphery of the pouch 108, thereby defining a border 120.

The transparent and flexible pouch 108 depicted in FIG. 3, however, does not make use of all of the aspects of the present invention. In particular, the pouch 108 in FIG. 3 does not include the transparent insert 116 or any other generally rigid means for controlling deformation discussed herein. FIG. 3 is illustrated in this manner to show how the deformable object 110 is compressed non-uniformly from both sides, without the insert 116, which results in a distortion of the deformable object. This can also result in creases 122 in the pouch 108.

The transparent and flexible pouch 108 may be coupled to any portion of the greeting card 100, such as depicted in FIG. 1. For example, the transparent and flexible pouch 108 may be coupled to front or rear surfaces of the front panel 104 or of the rear panel 106. As depicted in FIG. 1, the pouch 108 is adhered to the front surface of the rear panel 106 so the pouch 108 is inside the greeting card 100. The pouch may be adhered on the back around the border 120. Alternatively, and as discussed below with reference to FIGS. 9-10, the transparent and flexible pouch may be inserted into a pocket 140 formed into the front panel 104 or the rear panel 106 of the greeting card 100.

Further, and if desired for aesthetic or mechanical reasons, the transparent and flexible pouch 108 may be further coupled to the greeting card 100 with a flexible frame member 226. The flexible frame member 226 may encompass the transparent and flexible pouch 108 partially or entirely, and provide support and ornamentation for the transparent and flexible pouch 108, as well as an attachment area surrounding the pouch 108. The flexible frame member 120 may be made from cardboard, plastic, paper, or the like for increasing the aesthetic appearance and partially covering the transparent and flexible pouch 108, much like a picture frame. Further, in accordance with aspects herein, the flexible frame member may be made from the same material as the card body (e.g., both the greeting card and the flexible frame member may be made from paper). In aspects in which the flexible frame member 120 is made from the same material as the card body 102, the flexible frame member 120 may be integrally formed into the card body 102. Alternatively, the transparent and flexible pouch 108 may be removably coupled to a portion of the card body through use of adhesives or other types of temporary physical coupling, such as stapling or tape.

Figure 4:
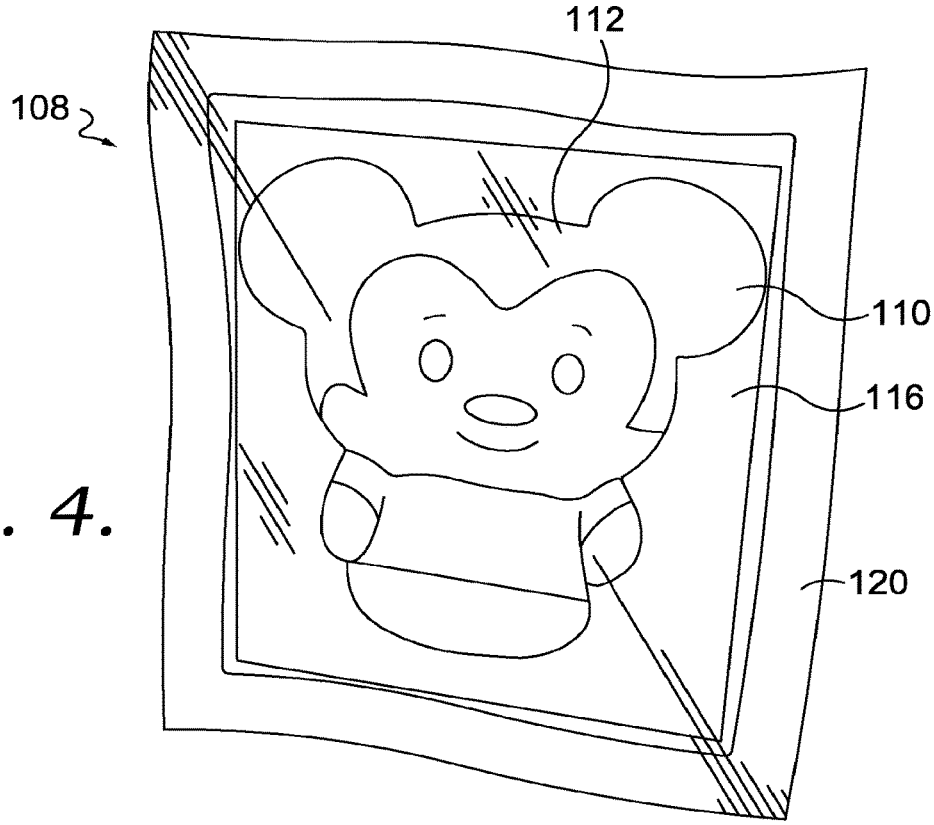
FIG. 4 is a front perspective view of the transparent and flexible pouch of FIG. 1 having a deformable object therein in a compressed state, but with a transparent and rigid insert for selectively controlling deformation of the deformable object in accordance with an aspect of the present invention.
Figure 6:
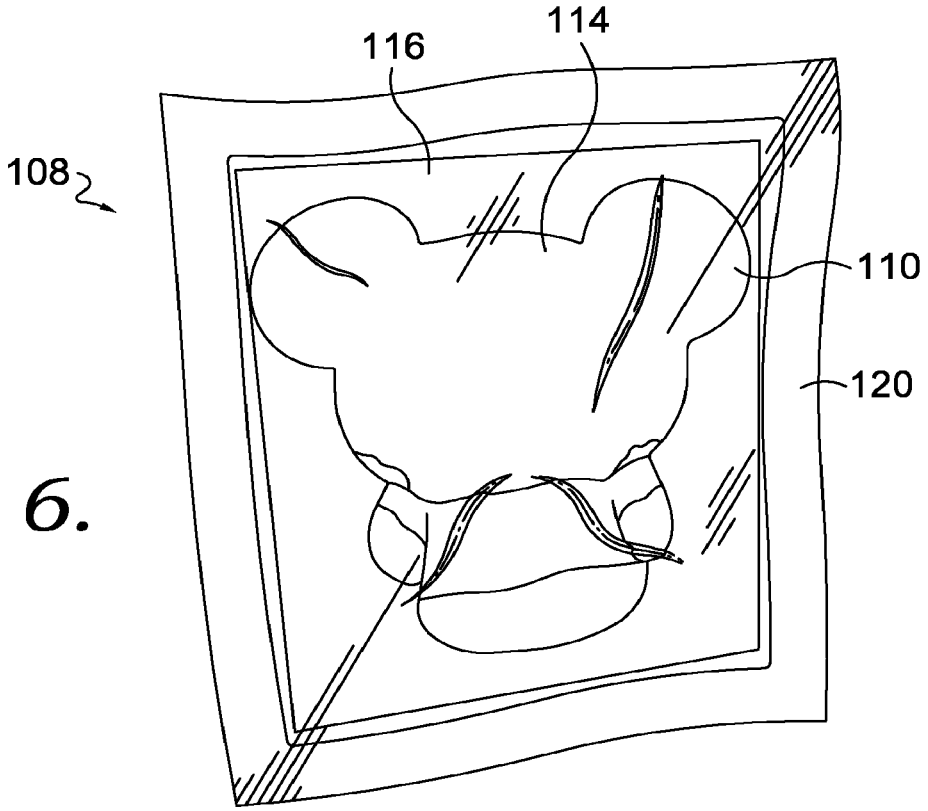
FIG. 6 is a rear perspective view of the transparent and flexible pouch of FIG. 4 illustrating the deformation of the pouch on a rear of the compressed deformable object.

FIG. 4 is a front view of the transparent and flexible pouch 108 with the deformable object 110 vacuum sealed therein is depicted. In contrast to FIG. 3, a transparent insert 116 was inserted in the pouch 108 before the pouch 108 was vacuum sealed. Now, when the air was removed from the pouch 108, the insert 116, being relatively rigid compared to the material used for the two sheets of material that form the pouch 108, resists deformation, at least more so than the rear sheet of the pouch 108. Consequently, the rear sheet deforms more easily, thereby pressing the front surface 112 of the deformable object 110 up against the insert 116 and flattening the front surface 112 of the deformable object 110 uniformly. The rear sheet, however and as depicted in FIG. 6, is allowed to deform randomly, creating creases 122. However, the creases 122 on the rear sheet are not visible when the pouch 108 is coupled with the greeting card 100.

Figure 5:
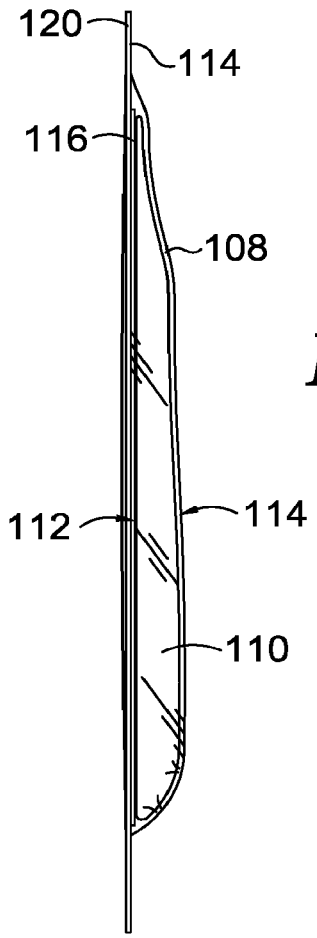
FIG. 5 is a side elevation view of the greeting card of FIG. 1 with the transparent and flexible pouch having the deformable object compressed therein against the insert and a front panel omitted for clarity.

Turning now to FIG. 5, a side view of the exemplary transparent and flexible pouch 108 in FIG. 4 is depicted. The deformable object 110 is seen in a "compressed state." The deformable object 110 has been compressed in a manner such that the rear surface 114 of the deformable object 110 is distorted, but the front surface 112 of the deformable object is pressed flat up against the insert 116, thus preserving the pleasing aesthetics of the front surface 112 of the deformable object 110.

Turning now to FIG. 7, a partially-exploded view of the transparent and flexible pouch 108 is depicted at the beginning of the assembly phase. The insert 116 and the object 110 are inserted into the pouch through the opening in the top. Air is then removed from the pouch and the top is sealed. As discussed previously, the transparent insert 116 is generally more rigid than the material that forms the front and back walls of the transparent and flexible pouch 108. Accordingly, when the transparent and flexible pouch 108 is vacuum-sealed, the deformable object 110 compresses in a manner that the front surface 112 of the compressible object 110 is pressed up against the non-deforming insert 116 and does not become disfigured. In other words, the deformable object 110 compresses in a manner that the rear surface 114 of the deformable object 110 distorts more than the front surface 112 of the deformable object 110. Once compressed and sealed, the pouch 108 looks like the pouch in FIG. 4 from the front and FIG. 6 from the back.

Figure 8:
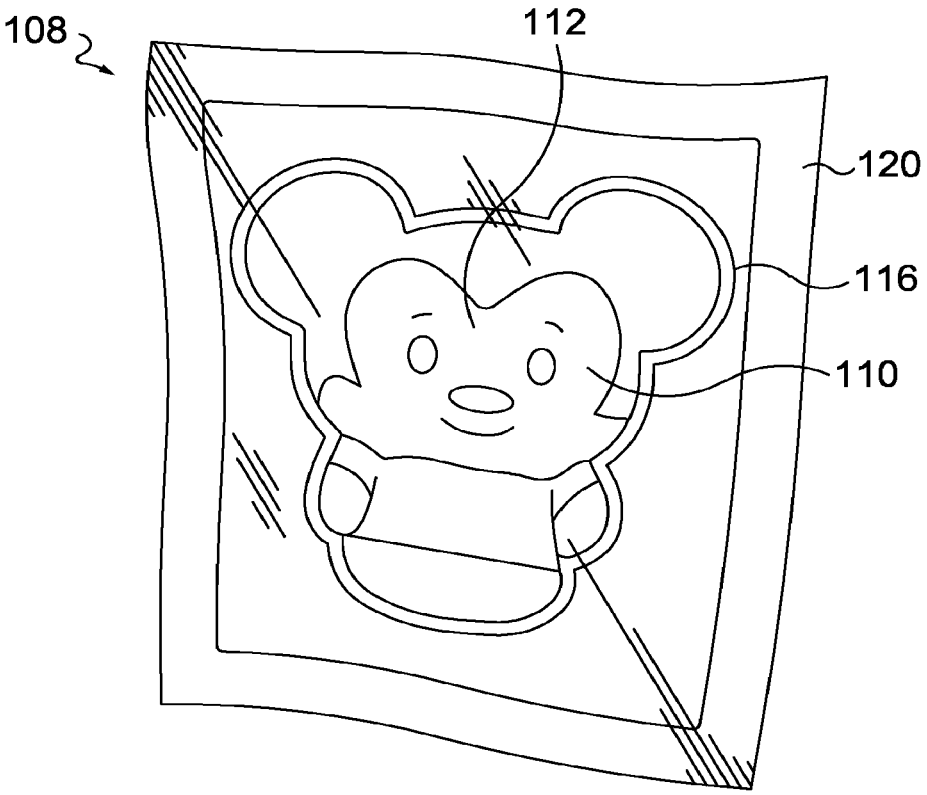
FIG. 8 is a front perspective view of a transparent and flexible pouch having a transparent and rigid insert corresponding to the shape of the deformable object, in accordance with an alternate embodiment of the invention described herein.

As depicted in FIG. 8, the transparent insert 116 may be made to be commensurate in size and in shape with the deformable object 110. For example, FIG. 8 depicts the deformable object 110 as a plush bear and the transparent insert 116 corresponding to the outline of the plush bear. In another example, the deformable object 110 may be a plush Christmas tree, as shown in FIG. 2, having the transparent insert 116 corresponding to the outline of the Christmas tree.

In other aspects herein, the transparent insert 116 may be removed completely by forming the transparent and flexible pouch 108 such that one side or panel (e.g., the front panel) of the transparent and flexible pouch 108 is more rigid than the other panel (e.g., the back panel) of the pouch. In doing so, the need for the transparent insert 116 may be alleviated, as the transparent and flexible pouch compresses from the rear panel, as opposed to compressing from both panels.

Figure 9:
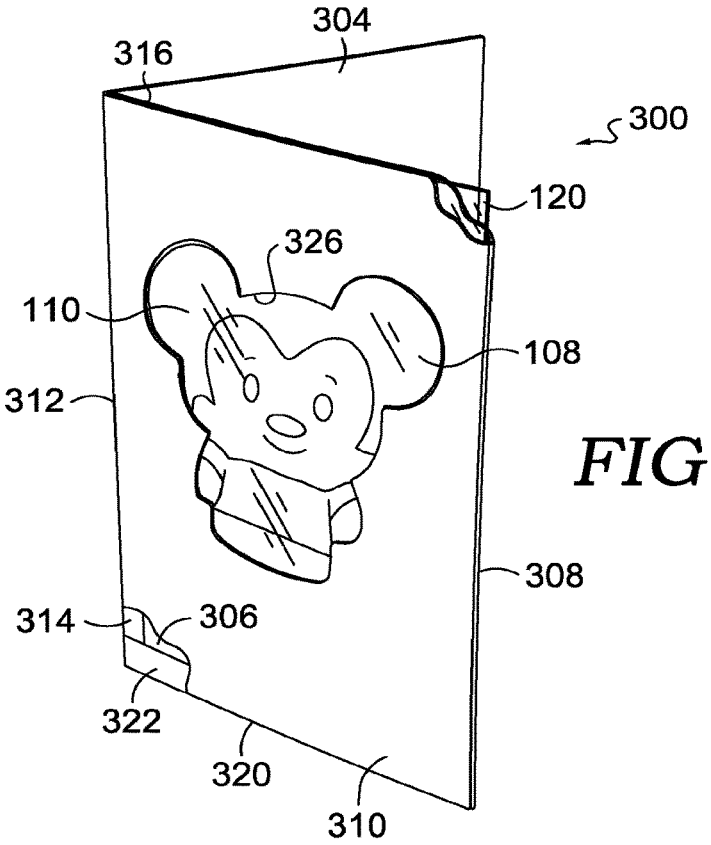
FIG. 9 is a front perspective view of a greeting card having a pocket for receiving a compressed transparent and flexible pouch in accordance with an alternate embodiment of the present invention.
Figure 10:
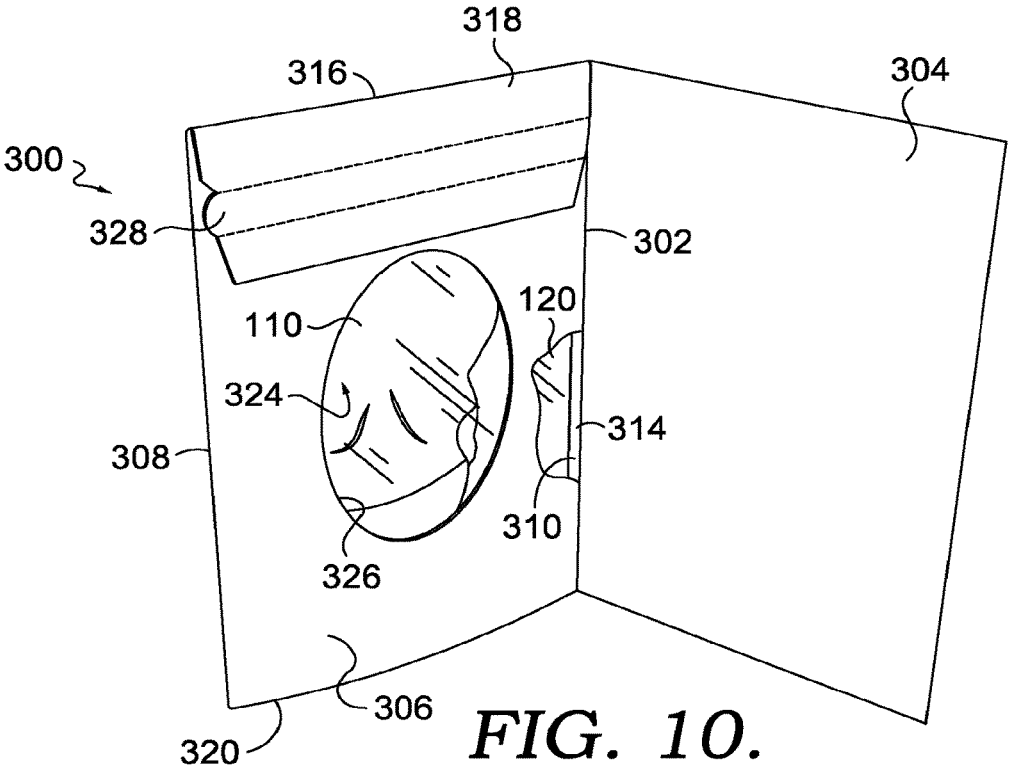
FIG. 10 is an interior perspective view of the greeting card of FIG. 9.

Turning now to FIGS. 9-10, an alternate embodiment of a greeting card body 300 is disclosed. The card body 300 is formed from a single, unitary piece of card stock with three parallel fold lines along its length. A first fold line 302 defines a rear panel 304 of the card 300 and one edge of an interior panel 306. A second fold line 308 defines a second edge of the interior panel 306 and a first edge of a front panel 310. A third fold line 312 defines a second edge of the front panel 310 and a long glue flap 314. A fourth fold line 316 at a top of the front panel 310 and perpendicular to the first three fold lines defines a closure flap 318. And, a fifth fold line 320 parallel to and opposite the fourth fold line 316 defines a short glue flap 322.

The glue flaps 314, 322, respectively, secure the side and bottom of the front panel 310 to the interior panel 306 and help to define a pocket 324. The pocket 324 receives the vacuum sealed pouch 108 with the compressed object 110 therein. The front and/or interior panels 310, 306 may have apertures 326 therein so the object 110 is viewable. The recipient of the greeting card 300 may remove the pouch 108 from the pocket 324 by pulling on a tear strip 328.

Figure 11:
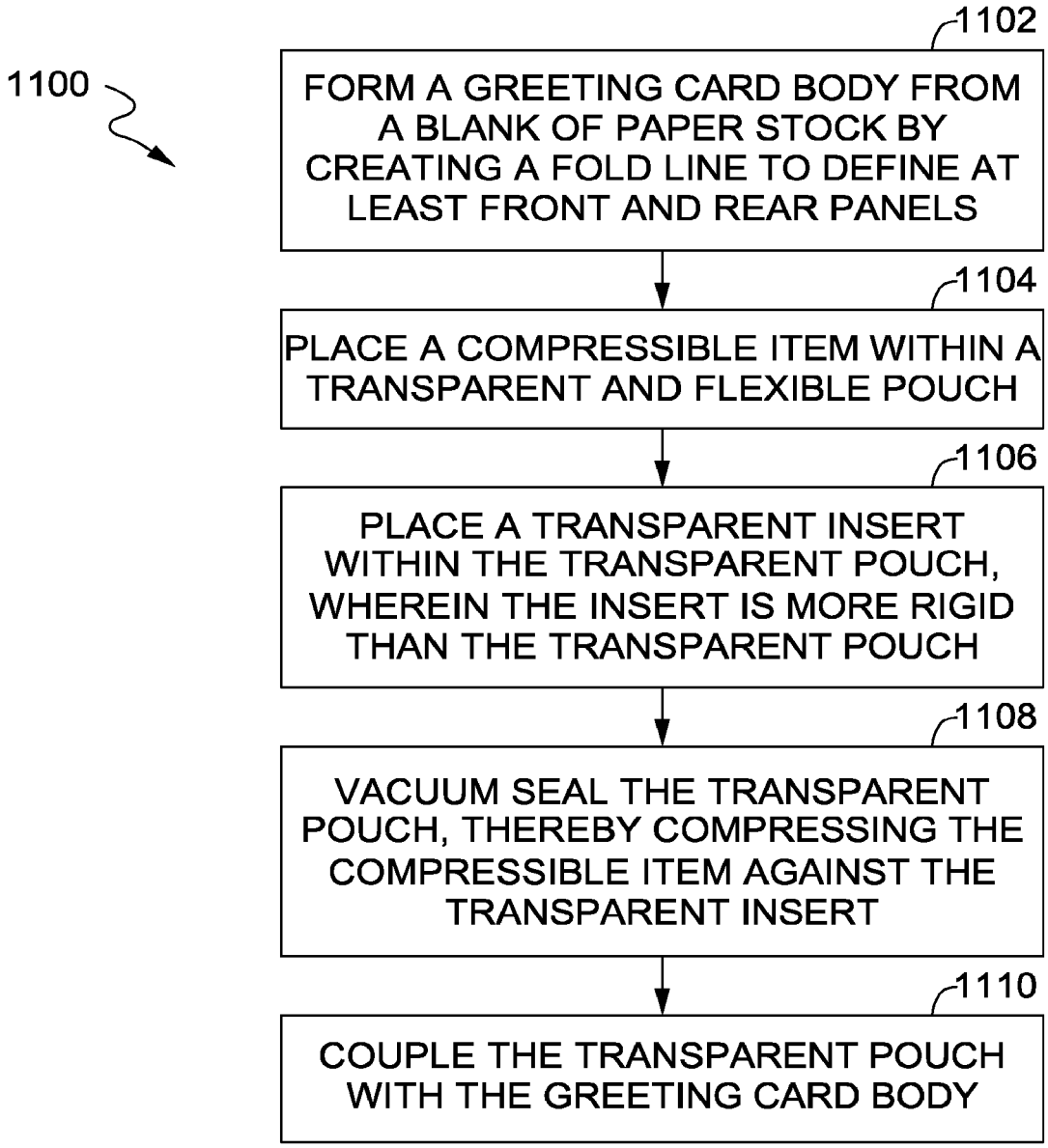
FIG. 11 is a block diagram of an exemplary method of manufacturing a greeting card having a deformable object coupled thereto, in accordance with aspects herein.

Turning now to FIG. 11, an exemplary method 1100 of manufacturing the greeting card 100 is depicted. In block 1102, the step of forming a greeting card body from a blank of paper stock by creating a fold line to define at least a front panel and a rear panel is depicted. As discussed previously, the card body will generally comprise at least a front panel and a rear panel, although single panel cards and multi-panel cards with intervening panels may be present such that the front panel and the rear panel are not directly coupled to one another.

At block 1104, placing a compressible item (or as used throughout this disclosure, a "deformable object"), such as a plush toy, within the transparent and flexible pouch is depicted. Similarly, at block 1106, the step of placing a transparent insert into the transparent and flexible pouch is depicted. It is noted that transparent insert is more rigid than the transparent and flexible pouch. This is to control the location of deformation as the pouch and compressible item are compressed. As discussed previously, the need for a transparent insert may be alleviated through use of a transparent and flexible pouch having a panel or portion of a panel that is more rigid than the others or more rigid that other portions of the pouch.

Once all the items are in the pouch, block 1108 depicts the step of vacuum sealing the pouch, thereby compressing the compressible item against the transparent insert. At step 1110, the transparent and flexible pouch is coupled with the card body. As discussed previously, the coupling of the transparent and flexible pouch to the card body may be a permanent coupling or a removable coupling. Alternatively, the transparent and flexible pouch may be integrally formed into the card body.

From the foregoing, it will be seen that this invention is one well adapted to attain all the ends and objects hereinabove set forth together with other advantages, which are obvious and which are inherent to the structure. It will be understood that certain features and subcombinations are of utility and may be employed without reference to other features and subcombinations. This is contemplated by and is within the scope of the claims. For example, the present invention includes a method of controlling deformation of an object during a vacuum sealing process. In one embodiment, the method includes placing an insert in a vacuum sealing pouch that is generally more rigid or less susceptible to deformation than a portion of the vacuum sealing pouch, whereby deformation is more likely to occur in areas of the pouch that are more susceptible to deformation than it is to occur in the localized region of the generally more rigid insert. In another embodiment a portion of the vacuum sealing pouch is generally more rigid than other areas of the pouch to selectively control deformation in the localized area adjacent the generally more rigid portion.

Since many possible embodiments may be made of the invention without departing from the scope thereof, it is to be understood that all matter herein set forth or shown in the accompanying drawings is to be interpreted as illustrative and not in a limiting sense.

The invention claimed is:

1. A greeting card having a gift item of a temporarily reduced size, the greeting card comprising:

a greeting card body having at least a front panel and a rear panel;

a transparent and flexible pouch coupled to the card body, wherein the transparent and flexible pouch is sealed under vacuum-pressure;

a plush item received in the transparent and flexible pouch and in a compressed state from the vacuum-pressure, the plush having a front surface and a rear surface; and a transparent insert received in the transparent and flexible pouch, wherein the transparent insert is more rigid than the transparent and flexible pouch;

wherein the transparent insert comprises a front surface and a back surface, wherein the front surface of the plush item is pressed up against the back surface of the transparent insert by the vacuum-pressure, and wherein the transparent insert minimizes deformation of the front surface of the plush item adjacent the insert during the vacuum process.

2. The greeting card of claim 1, wherein the front panel includes an aperture through which the plush item is visible when the greeting card is in a closed position.

3. The greeting card of claim 2, wherein the shape of the aperture corresponds to the shape of the plush item.

4. The greeting card of claim 1 further comprising a message printed on the greeting card, wherein the plush item is related to the message.

5. The greeting card of claim 1, wherein the transparent and flexible pouch is coupled to a rear panel of the card body.

6. The greeting card of claim 1, wherein the transparent and flexible pouch is removably coupled to the card body.

7. The greeting card of claim 1, further comprising a flexible frame member that surrounds a portion of the transparent and flexible pouch.

8. The greeting card of claim 7, wherein the flexible frame member is made from at least one of cardboard, plastic or paper.

9. The greeting card of claim 7, wherein the flexible frame member is integrally formed with the card body.

10. The greeting card of claim 1, wherein the front surface of the plush item includes a face of a character.

11. A greeting card with a compressible gift item comprising:

a card body having a plurality of panels;

a transparent and flexible pouch coupled with the card body having a front surface and a back surface, wherein at least one section of the pouch is less deformable than another section of the pouch, and wherein the less deformable section of the pouch is part of the front surface; and a deformable object received in the pouch between the front surface and the back surface;

wherein the transparent and flexible pouch is vacuum-sealed, wherein the front surface of the deformable object is pressed up against the less deformable section of the front surface of the pouch, and wherein the deformable object is maintained in a compressed state while the pouch is sealed, whereby opening the transparent and flexible pouch removes the vacuum-pressure on the deformable object and it returns to rest state.

12. The greeting card of claim 11, wherein the at least one section of the pouch is less deformable because the at least one section is more rigid than another portion of the pouch.

13. The greeting card of claim 11, wherein the at least one section of the pouch is less deformable because the transparent and flexible pouch further encloses a transparent insert which is more rigid than the transparent and flexible pouch and the transparent insert restricts deformation of the pouch in the area of the transparent insert.

14. The greeting card of claim 11, wherein at least one of the plurality of panels includes an aperture through which the plush item is visible and wherein the front surface of the deformable object and the less deformable section of the front surface of the pouch are viewable through the aperture.

15. The greeting card of claim 14, wherein the size and shape of the aperture corresponds with the size and shape of the deformable object.

16. The greeting card of claim 11, wherein the deformable object is made from the group consisting of plush and foam.

17. A method of manufacturing a greeting card having a compressible gift item with a front surface and a rear surface, the method comprising:

forming a greeting card body from a blank of paper stock by creating a fold line to define at least a front panel and a rear panel;

placing a compressible item with a back surface within a transparent and flexible pouch;

placing a transparent insert within the transparent and flexible pouch, thereby separating a portion of the front surface of the compressible item from abutting contact with the flexible pouch, wherein the transparent insert is more rigid than the transparent and flexible pouch;

vacuum-sealing the compressible item and the transparent insert within the transparent and flexible pouch, wherein the portion of the front surface of the compressible item pressed up against the back surface of the transparent insert; and coupling the transparent and flexible pouch to the card body.

18. The method of manufacturing of claim 17, further comprising cutting an aperture in the card body, such that the compressible item is visible through the aperture.

19. The method of manufacturing of claim 17, wherein the size and shape of the aperture corresponds to the size and shape of the compressible item.

20. The method of manufacturing of claim 17, further comprising providing a message on the card body which relates to the compressible item.

* * * * *